US011730991B2

(12) United States Patent
Helasuo

(10) Patent No.: US 11,730,991 B2
(45) Date of Patent: Aug. 22, 2023

(54) SPRINKLER SELF-DIAGNOSIS

(71) Applicant: MARIOFF CORPORATION OY, Vantaa (FI)

(72) Inventor: Jarmo Helasuo, Espoo (FI)

(73) Assignee: MARIOFF CORPORATION OY, Vantaa (FI)

( * ) Notice: Subject to any disclaimer, the term of this patent is extended or adjusted under 35 U.S.C. 154(b) by 233 days.

(21) Appl. No.: 15/734,810

(22) PCT Filed: Dec. 12, 2019

(86) PCT No.: PCT/EP2019/084862
§ 371 (c)(1),
(2) Date: Dec. 3, 2020

(87) PCT Pub. No.: WO2020/126812
PCT Pub. Date: Jun. 25, 2020

(65) Prior Publication Data

US 2021/0299500 A1 Sep. 30, 2021

(30) Foreign Application Priority Data

Dec. 17, 2018 (EP) ..... 18397534

(51) Int. Cl.
*A62C 37/50* (2006.01)
*A62C 37/14* (2006.01)

(52) U.S. Cl.
CPC ..... *A62C 37/50* (2013.01); *A62C 37/14* (2013.01)

(58) Field of Classification Search
CPC ..... A62C 35/58; A62C 35/60; A62C 35/64; A62C 37/14; A62C 37/50
See application file for complete search history.

(56) References Cited

U.S. PATENT DOCUMENTS 3,874,455 A 4/1975 Klesow
4,434,855 A 3/1984 Given, Jr.
5,373,989 A 12/1994 Hattori
(Continued)

FOREIGN PATENT DOCUMENTS

CN 104955531 A 9/2015
CN 104955532 A 9/2015
(Continued)

OTHER PUBLICATIONS

PCT International Search Report and Written Opinion; dated Feb. 17, 2020; Application No. PCT/US19/057340; Filed: Dec. 12, 2019; 13 pages.
(Continued)

*Primary Examiner* — Darren W Gorman
(74) *Attorney, Agent, or Firm* — Cantor Colburn LLP

(57) ABSTRACT

Methods and systems for sprinkler system (100) diagnostics are provided. Aspects include increasing, by a controller (115), a fluid pressure in a pipe (14) to a first pressure, wherein the pipe (14) is coupled to at least one sprinkler (40), receiving, from a sensor (50), first sensor data associated with a moving portion (210) of the least one sprinkler (40), wherein the first sensor data includes a first movement distance (250) of the moving portion (210) of the at least one sprinkler (40), and enacting a first action based at least in part on the first movement distance (250) being less than a threshold.

20 Claims, 3 Drawing Sheets

(56) References Cited

U.S. PATENT DOCUMENTS

| | | | | |
|---|---|---|---|---|
| 5,390,744 | A | 2/1995 | McHugh | |
| 7,048,068 | B2 | 5/2006 | Paulkovich | |
| 7,134,507 | B2 * | 11/2006 | Heskestad | A62C 37/50 239/203 |
| 7,633,393 | B2 * | 12/2009 | Bonne | A62C 37/50 340/539.22 |
| 9,964,495 | B1 | 5/2018 | Marshall et al. | |
| 2013/0126194 | A1 * | 5/2013 | Kjellberg | A62C 31/07 169/37 |
| 2016/0059057 | A1 | 3/2016 | Disimile | |
| 2017/0100617 | A1 * | 4/2017 | Kochelek | A62C 37/50 |
| 2018/0214726 | A1 * | 8/2018 | Nelson | A62C 35/68 |
| 2019/0366138 | A1 * | 12/2019 | Mull | A62C 35/62 |

FOREIGN PATENT DOCUMENTS

| | | | |
|---|---|---|---|
| EP | 3669952 | A1 | 6/2020 |
| IN | 1803CHENP2013 | | 7/2014 |
| JP | 2015205223 | A | 11/2015 |
| KR | 101725900 | B1 | 4/2017 |
| WO | 2006001725 | A1 | 2/2006 |
| WO | 2007019559 | A2 | 2/2007 |
| WO | 2012015351 | A1 | 2/2012 |
| WO | 2012021552 | A2 | 2/2012 |
| WO | 2018175495 | A1 | 9/2018 |

OTHER PUBLICATIONS

EP Search Report; dated May 28, 2019; Application No. 18397534.1; dated Dec. 17, 2018; 2 pages.

PCT International Search Report; dated Nov. 14, 2011; Application No. PCT/SE2011/050807; Filed: Jun. 21, 2011; 5 pages.

International Preliminary Report on Patentability, Mailed: Jul. 1, 2021, Application No. PCT/EP19/084862, Filed: Dec. 12, 2019, 8 pages.

* cited by examiner

SPRINKLER SELF-DIAGNOSIS

BACKGROUND

The embodiments disclosed herein relate generally to sprinkler systems, and more particularly, to a sprinkler self-diagnosis system and a sprinkler system for use thereof.

Sprinkler systems typically include a plurality of sprinklers for emitting a fire suppression fluid in the event of a fire. These sprinklers often include an internal spool or other closure element which opens when a heat sensitive element, such as a glass bulb, is activated. Testing of these sprinklers can be problematic as typically there are multiple sprinklers on multiple floors of a building or in different areas on ships, for example. Testing of sprinklers is problematic because typically the glass bulb needs to be broken in order to see if the sprinkler would activate as defined. The released sprinkler needs to be then replaced with a new sprinkler, usually it cannot be reset. For this reason, only few sprinklers can be tested at a time. Individual inspection of each sprinkler can thus take time and effort for maintenance personnel.

BRIEF SUMMARY

According to an embodiment, a sprinkler system is provided. The sprinkler system includes a fluid source, a pipe coupled to the fluid source, at least one sprinkler coupled to the pipe, a sensor configured to measure a movement distance of a moving portion of the at least one sprinkler, and a controller configured to increase a fluid pressure for the at least one sprinkler to a first pressure, receive first sensor data, from the sensor, associated with the moving portion of the least one sprinkler, wherein the first sensor data includes a first movement distance of the moving portion of the at least one sprinkler, and enact a first action based at least in part on the first movement distance being less than a threshold.

In addition to one or more of the features described herein, or as an alternative, further embodiments may include that the controller is further configured to increase the fluid pressure for the at least one sprinkler to a second pressure, receive second sensor data, from the sensor, associated with the moving portion of the least one sprinkler, wherein the second sensor data includes a second movement distance of the moving portion of the at least one sprinkler, and enact a second action based at least in part on the second movement distance being less than the threshold.

In addition to one or more of the features described herein, or as an alternative, further embodiments may include that the increasing the fluid pressure for the at least one sprinkler to the first pressure comprises a gradual increase in the fluid pressure to the first pressure.

In addition to one or more of the features described herein, or as an alternative, further embodiments may include that the first action includes a transmission, by the controller, of a maintenance action for the at least one sprinkler to a maintenance system.

In addition to one or more of the features described herein, or as an alternative, further embodiments may include that the second action includes an alarm indicating that the at least one sprinkler is inoperable.

In addition to one or more of the features described herein, or as an alternative, further embodiments may include that the at least one sprinkler includes a sprinkler body having a fluid inlet, a seal configured to prevent fluid flow through the sprinkler body when the seal is in a first position, and a bulb configured to retain the seal in the first position, the bulb configured to break at a temperature and allow the seal to move to a second position allowing fluid flow through the sprinkler body In addition to one or more of the features described herein, or as an alternative, further embodiments may include that the moving portion of the at least sprinkler includes the seal.

In addition to one or more of the features described herein, or as an alternative, further embodiments may include that the sensor comprises potential free contacts comprising a first contact and a second contact, wherein the first movement distance exceeding the threshold causes the first contact and the second contact to close.

In addition to one or more of the features described herein, or as an alternative, further embodiments may include that the sensor comprises a proximity sensor having a power source.

In addition to one or more of the features described herein, or as an alternative, further embodiments may include that the power source comprises a battery.

According to an embodiment, a method for operating a sprinkler for self-diagnosis is provided. The method includes increasing, by a controller, a fluid pressure in a pipe to a first pressure, wherein the pipe is coupled to at least one sprinkler, receiving, from a sensor, first sensor data associated with a moving portion of the least one sprinkler, wherein the first sensor data includes a first movement distance of the moving portion of the at least one sprinkler, and enacting a first action based at least in part on the first movement distance being less than a threshold.

In addition to one or more of the features described herein, or as an alternative, further embodiments may include increasing, by the controller, the fluid pressure for the at least one sprinkler to a second pressure, receiving second sensor data, from the sensor, associated with the moving portion of the least one sprinkler, wherein the second sensor data includes a second movement distance of the moving portion of the at least one sprinkler, and enacting a second action based at least in part on the second movement distance being less than the threshold.

In addition to one or more of the features described herein, or as an alternative, further embodiments may include that the increasing the fluid pressure for the at least one sprinkler to the first pressure comprises a gradual increase in the fluid pressure to the first pressure.

In addition to one or more of the features described herein, or as an alternative, further embodiments may include that the first action includes a transmission, by the controller, of a maintenance action for the at least one sprinkler to a maintenance system.

In addition to one or more of the features described herein, or as an alternative, further embodiments may include that the second action includes an alarm indicating that the at least one sprinkler is inoperable.

In addition to one or more of the features described herein, or as an alternative, further embodiments may include that the at least one sprinkler comprises a sprinkler body having a fluid inlet, a seal configured to prevent fluid flow through the sprinkler body when the seal is in a first position, and a bulb configured to retain the seal in the first position, the bulb configured to break at a temperature and allow the seal to move to a second position allowing fluid flow through the sprinkler body.

In addition to one or more of the features described herein, or as an alternative, further embodiments may include that the moving portion of the at least sprinkler includes the seal.

In addition to one or more of the features described herein, or as an alternative, further embodiments may include that the sensor comprises potential free contacts comprising a first contact and a second contact, wherein the first movement distance exceeding the threshold causes the first contact and the second contact to close.

In addition to one or more of the features described herein, or as an alternative, further embodiments may include that the sensor comprises a proximity sensor having a power source.

In addition to one or more of the features described herein, or as an alternative, further embodiments may include that the power source comprises a battery.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Sprinklers are distributed throughout an area to provide fire suppression. However, a typical sprinkler can stand by for a long period of time, but is required to work properly when activated. When sprinklers are on stand by for a long period of time, performance issues arise based on age related problems such as, for example, aging materials, accumulation of dissolved impurities in water, and corrosion. These age related problems can increase the friction of the sprinkler's internal spindle and eventually will prevent movement of components of the sprinkler all together. Testing sprinklers can be difficult without fully activating the sprinkler system.

The techniques described herein provide for a sprinkler system that includes a sensing device to test each sprinkler head functionality in the sprinkler system without the need to activate the sprinkler or removing the sprinkler from its location.

Figure 1:
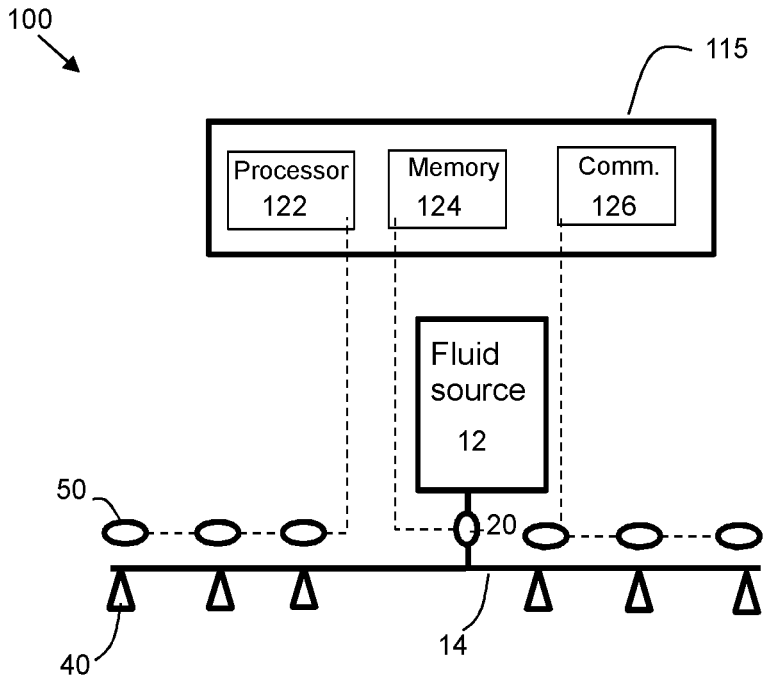
FIG. 1 depicts a sprinkler system in accordance with one or more embodiments.

FIG. 1 depicts a sprinkler system 100 in an example embodiment. The sprinkler system 100 includes a fluid source 12 connected to one or more sprinklers 40 via one or more pipes 14. The fluid source 12 may be water and may be under pressure to direct the fluid to the sprinklers 40. In other embodiments, a pump may be used to direct fluid to the sprinklers 40. The sprinkler system 100 may be a "wet pipe" type system, in which fluid is present in pipes 14. Upon breakage of a bulb at a sprinkler 40, a seal is opened and fluid is emitted at the sprinkler 40.

A controller 115 communicates with elements of the sprinkler system 100 as described herein. The controller 115 may include a processor 122, a memory 124, and communication module 126. The processor 122 can be any type or combination of computer processors, such as a microprocessor, microcontroller, digital signal processor, application specific integrated circuit, programmable logic device, and/or field programmable gate array. The memory 124 is an example of a non-transitory computer readable storage medium tangibly embodied in the controller 115 including executable instructions stored therein, for instance, as firmware. The communication module 126 may implement one or more communication protocols to communicate with other system elements. The communication module 126 may communicate over a wireless network, such as 802.11x (WiFi), short-range radio (Bluetooth), or any other known type of wireless communication. The communication module 126 may communicate over wired networks such as LAN, WAN, Internet, etc.

One or more sprinkler sensors 50 obtain movement distance data from each sprinkler 40. The movement distance refers to the distance moved by a moving component of a sprinkler. In one or more embodiments, the moving component can be a seal or plug that acts to block fluid flow through the sprinkler until a bulb holding the seal in place is broken. The sprinkler sensors 50 communicate with controller 115 over a wireless and/or wired network. The sprinkler sensors 50 may also form a mesh network, where data is transferred from one sprinkler sensors 50 to the next, eventually leading to the controller 115. In one or more embodiments, each sprinkler sensors 50 is programmed with a unique, sprinkler sensor identification code that identifies each sprinkler sensor 50 to the controller 115.

The sprinkler system 100 includes one or more fluid sensors 20. Fluid sensor 20 detects one or more fluid parameters, such as fluid pressure in pipes 14 or fluid flow in pipes 14. The fluid sensor(s) 20 may be located at the outlet of the fluid source 12 or along various locations along pipes 14. The fluid parameter can be used by the controller 115 to determine the status of the sprinkler system 100 (e.g., has a sprinkler 40 been activated). The fluid sensor 20 communicates with controller 115 over a wireless and/or wired network. In one or more embodiments, the fluid source can be water or any other type of fire suppressant. The controller 115 may operate an alarm when a flow rate greater than zero is detected in at least one of the pipes 14. The alarm may be audible, vibratory, and/or visual.

Figure 2A:
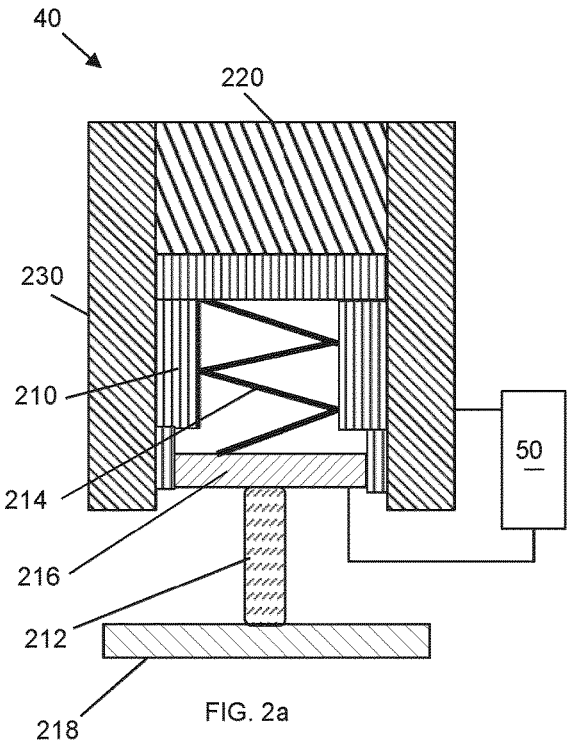
FIG. 2*a* depicts a block diagram of an exemplary sprinkler according to one or more embodiments.

FIG. 2*a* depicts a block diagram of an exemplary sprinkler according to one or more embodiments. The sprinkler 40 includes a sprinkler body 230 and a fluid inlet 220. The sprinkler 40 also includes a sealing assembly (sometimes referred herein as "spindle") that prevents fluid from flowing through the sprinkler body 230 from the fluid inlet 220 when the sealing assembly is engaged. The sealing assembly includes a moving element 210, a spring 214 pressing against a sealing element 216 of the sealing assembly. The sealing element 216 is in contact with a bulb 212 that acts against the spring 214 in the sealing assembly to keep the sealing assembly engaged while the bulb 212 is not broken. The moving element 210 can move partially and still be engaged such that no fluid flows through the sprinkler body 230. The bulb 212 is held in place by a deflector plate 218. When the bulb 212 is broken (due to fire or heat), the spring 214 causes the moving element 210 and sealing element 216 to disengage allowing fluid to flow through the sprinkler body 230 and make contact with the deflector plate 218 to disperse the fluid. In one or more embodiments, the sprinkler 40 includes a sensor 50 configured to measure a movement distance of the moving element 210 of the sealing assembly.

Figure 2B:
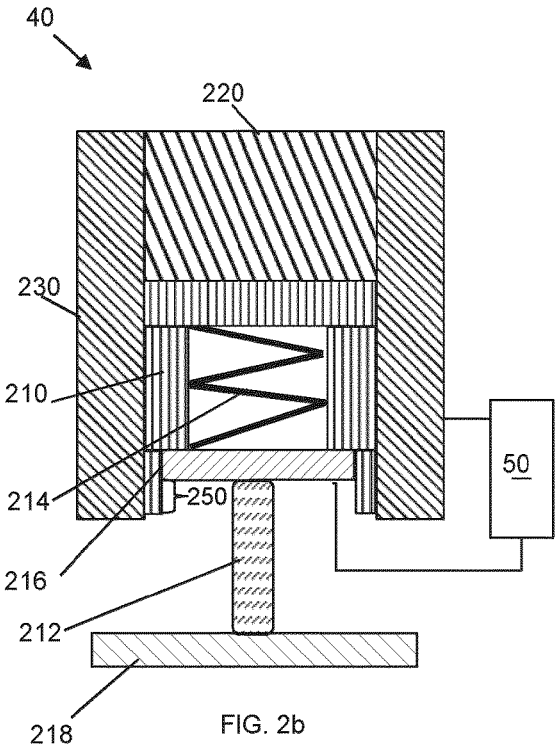
FIG. 2*b* depicts a block diagram of the sprinkler performing a self-diagnosis test according to one or more embodiments.

FIG. 2*b* depicts a block diagram of the sprinkler 40 performing a self-diagnosis test according to one or more embodiments. In one or more embodiments, the controller 115 (FIG. 1) can increase the pressure of the fluid in the fluid inlet 220. The increase in fluid pressure causes the moving element 210 of the sealing assembly to move downward in the sprinkler body 230. The sealing element 216 is held in place because the bulb 212 is not broken while the moving element 210 is moved to a different position. The moving distance 250 can be measured by the sensor 50 and the sensor 50 can transmit this moving distance data to the controller 115 for processing. The sensor 50 can be any type of sensor including, but not limited to, a proximity sensor or potential free contacts. The sensor 50 can include a power supply such as, for example, a battery.

In one or more embodiments, the controller 115 can gradually increase the pressure of the fluid in the fluid inlet 220 and receive movement data 250 from the sensor 50. As the pressure increases, the movement distance should increase as well. Once the movement distance exceeds a threshold distance, the pressure increase can be determined from a fluid sensor 20 (FIG. 1). For moving elements 210 that reach the threshold moving distance by certain pressure levels, the associated sprinkler can be determined to be in good working order. However, should a moving element 210 not reach the threshold or require a higher pressure level to reach the threshold, an action can be enacted by the controller 115 such as an alarm or a maintenance request for the sprinkler. In one or more embodiments, as the controller 115 increases the pressure of the fluid, the time it takes for the moving element 210 to reach the threshold distance can be measured. A threshold time period can be set to determine if a sprinkler is in good working order. Moving element 210 of sealing assemblies that exceed the threshold time period to reach the threshold distance can be determined to be in need of maintenance or replacement.

In one or more embodiments, the testing of the sprinkler 40 can be performed automatically on a period basis for a sprinkler system. The sensor data generated from the testing each sprinkler in a sprinkler system can be analyzed using a statistical model to generate predictive maintenance for each sprinkler in the system. As the sensor data is periodically collected by the sensors 50, a break-away pressure can be recorded and analyzed to determine a trend. If a trend in increased friction, for example, is determined, a maintenance visit can be schedule in the near future. The fluid pressures can be multiple pressure levels that can determine that a sprinkler is deemed inoperable or deemed operable but in need of maintenance.

Technical benefits of this system for sprinkler diagnosis include the cleaning of the sprinkler internal components from impurities and corrosion when the sealing assembly moves up and down responsive to an increase in fluid pressure and then subsequent reduction in fluid pressure to normal levels.

Figure 3:
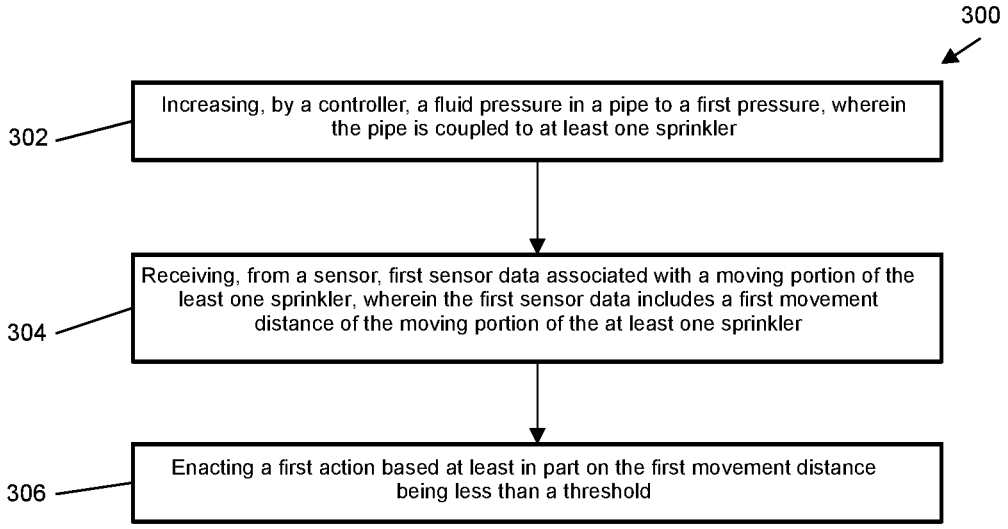
FIG. 3 depicts a flowchart of a method for sprinkler system diagnostics in accordance with one or more embodiments.

FIG. 3 depicts a flowchart of a method 300 for sprinkler system diagnostics in accordance with one or more embodiments. The method 300 includes increasing, by a controller, a fluid pressure in a pipe to a first pressure, wherein the pipe is coupled to at least one sprinkler, as shown in block 302. At block 304, the method 300 includes receiving, from a sensor, first sensor data associated with a moving portion of the least one sprinkler, wherein the first sensor data includes a first movement distance of the moving portion of the at least one sprinkler. And at block 306, the method 300 includes enacting a first action based at least in part on the first movement distance being less than a threshold.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A sprinkler system comprising:
- a fluid source;
- a pipe coupled to the fluid source;
- at least one sprinkler coupled to the pipe;
- a sensor configured to measure a movement distance of a moving portion of the at least one sprinkler; and
- a controller configured to:
  - increase a fluid pressure for the at least one sprinkler to a first pressure;
  - receive first sensor data, from the sensor, associated with the moving portion of the least one sprinkler, wherein the first sensor data includes a first movement distance of the moving portion of the at least one sprinkler; and
  - enact a first action based at least in part on the first movement distance being less than a threshold.

2. The sprinkler system of claim 1, wherein the controller is further configured to:
- increase the fluid pressure for the at least one sprinkler to a second pressure;
- receive second sensor data, from the sensor, associated with the moving portion of the least one sprinkler, wherein the second sensor data includes a second movement distance of the moving portion of the at least one sprinkler;
- enact a second action based at least in part on the second movement distance being less than the threshold.

3. The sprinkler system of claim 1, wherein the increasing the fluid pressure for the at least one sprinkler to the first pressure comprises a gradual increase in the fluid pressure to the first pressure.

4. The sprinkler system of claim 1, wherein the first action includes a transmission, by the controller, of a maintenance action for the at least one sprinkler to a maintenance system.

5. The sprinkler system of claim 2, wherein the second action includes an alarm indicating that the at least one sprinkler is inoperable.

6. The sprinkler system of claim 1, wherein the at least one sprinkler comprises:

a sprinkler body having a fluid inlet;

a seal configured to prevent fluid flow through the sprinkler body when the seal is in a first position; and a bulb configured to retain the seal in the first position, the bulb configured to break at a temperature and allow the seal to move to a second position allowing fluid flow through the sprinkler body.

7. The sprinkler system of claim 6, wherein the moving portion of the at least one sprinkler includes the seal.

8. The sprinkler system of claim 1, wherein the sensor comprises potential free contacts comprising a first contact and a second contact, wherein the first movement distance exceeding the threshold causes the first contact and the second contact to close.

9. The sprinkler system of claim 1, wherein the sensor comprises a proximity sensor having a power source.

10. The sprinkler system of claim 9, wherein the power source comprises a battery.

11. A method for sprinkler system diagnostics, the method comprising:

increasing, by a controller, a fluid pressure in a pipe to a first pressure, wherein the pipe is coupled to at least one sprinkler;

receiving, from a sensor, first sensor data associated with a moving portion of the least one sprinkler, wherein the first sensor data includes a first movement distance of the moving portion of the at least one sprinkler; and enacting a first action based at least in part on the first movement distance being less than a threshold.

12. The method of claim 11, further comprising:

increasing, by the controller, the fluid pressure for the at least one sprinkler to a second pressure;

receiving second sensor data, from the sensor, associated with the moving portion of the least one sprinkler, wherein the second sensor data includes a second movement distance of the moving portion of the at least one sprinkler; and enacting a second action based at least in part on the second movement distance being less than the threshold.

13. The method of claim 11, wherein the increasing the fluid pressure for the at least one sprinkler to the first pressure comprises a gradual increase in the fluid pressure to the first pressure.

14. The method of claim 11, wherein the first action includes a transmission, by the controller, of a maintenance action for the at least one sprinkler to a maintenance system.

15. The method of claim 12, wherein the second action includes an alarm indicating that the at least one sprinkler is inoperable.

16. The method of claim 11, wherein the at least one sprinkler comprises:

a sprinkler body having a fluid inlet;

a seal configured to prevent fluid flow through the sprinkler body when the seal is in a first position; and a bulb configured to retain the seal in the first position, the bulb configured to break at a temperature and allow the seal to move to a second position allowing fluid flow through the sprinkler body.

17. The method of claim 16, wherein the moving portion of the at least one sprinkler includes the seal.

18. The method of claim 11, wherein the sensor comprises potential free contacts comprising a first contact and a second contact, wherein the first movement distance exceeding the threshold causes the first contact and the second contact to close.

19. The method of claim 11, wherein the sensor comprises a proximity sensor having a power source.

20. The method of claim 19, wherein the power source comprises a battery.

* * * * *